United States Patent [19]

Martikainen

[11] 3,948,065

[45] Apr. 6, 1976

[54] CYLINDER LOCK

[75] Inventor: Kaarlo Martikainen, Joensuu, Finland

[73] Assignee: Oy Wartsila AB, Helsinki, Finland

[22] Filed: June 6, 1975

[21] Appl. No.: 584,492

[30] Foreign Application Priority Data

June 17, 1974 Finland ..... 1833/74

[52] U.S. Cl. ..... 70/1.5; 70/366; 70/377

[51] Int. Cl.[2] ..... E05B 63/00

[58] Field of Search ..... 70/1.5, 365, 366, 376, 70/377, 416, 419, 421

[56] References Cited

UNITED STATES PATENTS

| | | | |
|---|---|---|---|
| 2,613,528 | 10/1952 | Salmivuori | 70/366 |
| 3,313,134 | 4/1967 | Gahmberg | 70/376 |
| 3,789,638 | 2/1974 | Roberts | 70/366 |

*Primary Examiner*—Robert L. Wolfe

*Attorney, Agent, or Firm*—Haseltine, Lake & Waters

[57] ABSTRACT

A cylinder lock comprising an outer cylinder enclosing a hollow rotatable inner cylinder which, in turn, encloses a plurality of locking discs turnable with the key of the lock. Between the outer cylinder and the peripheral edges of the locking discs there is a locking bar locking the inner cylinder to the outer cylinder. This bar is movable from a position locking the inner cylinder, in which position the bar is located partly in a groove in the inner wall of the outer cylinder to a position releasing the inner cylinder. In the latter position the locking bar is received in a channel formed jointly by locking bar notches in the peripheral edges of the locking discs when the discs are brought to a certain position. The groove in the inner wall of the outer cylinder is provided with a lateral step, so that a deep groove portion and a shallow groove portion are formed. The different locking discs are provided, in addition to the locking bar notch, with a number of shallow notches, so dimensioned, that upon forming jointly by said shallow notches a channel at the position of the locking bar, the locking bar is able to move into the shallow groove portion and remains locked between the bottom of the shallow groove portion and the bottom of the shallow notches.

4 Claims, 1 Drawing Figure

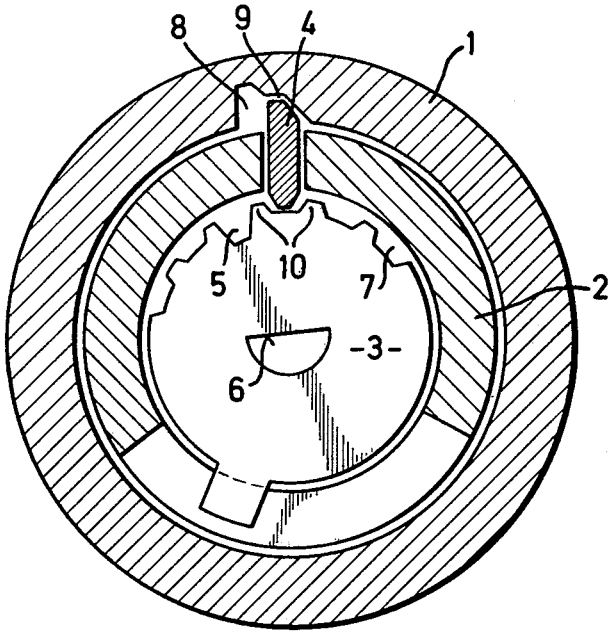
8
9
4
1
10
5
7
2
-3-
6

CYLINDER LOCK

The invention relates to a cylinder lock comprising an outer cylinder enclosing a rotatable inner cylinder which encloses a number of locking discs turnable with the key of the lock, and, between the outer cylinder and the peripheral edges of the locking discs, a locking bar locking the inner cylinder to the outer cylinder, which bar from a position locking the inner cylinder, in which position it is located partly in a groove in the inner wall of the outer cylinder, is movable to a position releasing the inner cylinder, by passing into a channel formed jointly by notches in the peripheral edges of the locking discs when brought to a certain position.

The disc cylinder lock is the most secure of known cylinder lock types. Nevertheless, even this type of lock has some drawbacks. Especially in very worn locks malfunction may sometimes occur. As to picking, this lock is particularly secure, but nevertheless, some rather theoretic picking possibilities have been developed, which, however, have never been of any practical importance, because they require complicated special tools and very far going expert know-how and still are troublesome and uncertain. A lock must, however, be developed with respect also to theoretical picking possibilities, so that they too are made impossible to practise.

The object of the invention is to create a disc cylinder lock, more secure in every respect than any known lock of this type. The invention is characterized in that the groove made in the inner wall of the outer cylinder for the locking bar is provided with a lateral step, the groove having thus two different depths, and that the locking discs, in addition to the ordinary locking bar notch, are provided with one or more shallow notches, so dimensioned that if a channel is formed jointly by the shallow notches at the position of the locking bar, the locking bar is able to move into the more shallow part of the step groove in the inner wall of the outer cylinder, but, nevertheless, remains locked in said groove. In a lock of this type, every effort to open the lock with anything but the right key brings the locking bar into a locked position between the shallow notches and the shallow part of the locking bar groove. Then also all the locking discs are locked and cannot be turned in order to find the right opening position.

If, in a lock according to the invention, the width of the locking bar, measured in the tangential direction of the inner cylinder, is so adapted to the angular pitch of the combination system of the lock, that between adjacent deep or shallow peripheral notches of the locking disc a small radial projection is formed, the advantage is obtained that there may be a notch at every combination step, as the notches can be made so narrow, that also between two adjacent combination steps there is a jut separating the two notches. If the locking bar is not made that narrow, there can be notches only at a few places and the desired effect of locking the locking bar is obtained in relatively few cases only.

In an ordinary cylinder lock with an outer diameter of the inner cylinder of about 13 mm, there may advantageously be used a locking bar with a width in the tangential direction of the inner cylinder of about 1 mm.

In the following, the invention is described more in detail with reference to the accompanying drawing, the single FIGURE of which schematically shows a cross-sectional view of a lock according to the invention.

In the drawing, 1 indicates the outer cylinder of the lock, 2 its inner cylinder, 3 the locking discs and 4 the locking bar. In the locking discs 3, there is a deep peripheral notch 5 into which the locking bar 4 has moved when it has reached a position releasing the inner cylinder. This presupposes that the deep notches 5 of all the locking discs have moved to the position of the locking bar 4, which is obtained by turning the key of the lock. In the centre of the locking discs, there is an opening 6 for the key of the lock. In the embodiment shown, this opening has a semicircular shape and the combination surfaces of the key act on one half of the linear edge of the semicircular opening.

If attempts are made to open the lock with any other means than the proper key of the lock, the shallow peripheral notches 7 of the locking discs form together a channel at the position of the locking bar 4 so that the locking bar is able to move somewhat in a radially inwards direction. Because of this small radial movement the locking bar 4 slips into the shallow part 9 of the step groove 8 for the locking bar provided in the wall of the outer cylinder 1. The locking bar 4 is, however, not able to slip out of the locking bar groove but stays in the shallow part of the groove, locked between the bottoms of the shallow notches 7 of the locking discs and the bottom of the shallow part 9 of the locking bar groove 8. In this case, also the locking discs are locked since on each side of every notch, deep or shallow, there is a small jut 10. This is of advantage, because the locking discs can now by no means be moved so that the right combination position could be found.

The invention is not limited to the embodiment shown, but several modifications of the invention are feasible within the scope of the following claims.

I claim:

1. A cylinder lock comprising an outer cylinder enclosing a rotatable inner cylinder which encloses a plurality of locking discs turnable with the key of the lock, and, between said outer cylinder and the peripheral edges of said locking discs, a locking bar locking said inner cylinder to said outer cylinder, which bar from a position locking the inner cylinder, in which position the bar is located partly in a groove in the inner wall of said outer cylinder, is movable to a position releasing said inner cylinder by passing into a channel formed jointly by locking bar notches in the peripheral edges of said locking discs when brought to a certain position, said groove in the inner wall of the outer cylinder being provided with a lateral step, so as to form, in said groove, a deep groove portion and a shallow groove portion, said locking discs, being provided, in addition to said locking bar notch, with a number of shallow notches, so dimensioned, that upon forming jointly by said shallow notches a channel at the position of said locking bar, the locking bar is able to move into the shallow groove portion, but remains locked between the bottom of said shallow groove portion and the bottom of said shallow notches.

2. A cylinder lock according to claim 1, in which the width of said locking bar, measured in the tangential direction of said inner cylinder, is so adapted to the angular pitch of the combination system of the lock, that between adjacent peripheral notches of said locking discs, a small radial projection is formed.

3. A cylinder lock according to claim 2, in which there is, in said locking discs, at every such position which, within the scope of the combination system used, may be brought to the position of said locking bar, a peripheral notch.

4. A cylinder lock according to claim 1, in which the width of said locking bar, measured in the tangential direction of said inner cylinder, is about 1 mm.

* * * * *